US007168787B2

(12) United States Patent
Jung et al.

(10) Patent No.: US 7,168,787 B2
(45) Date of Patent: Jan. 30, 2007

(54) MONOLITHIC BUBBLE-INK JET PRINT HEAD HAVING ANTI-CURING-DEFORMATION PART AND FABRICATION METHOD THEREOF

(75) Inventors: Myung-song Jung, Gun-po (KR); Jung-woog Son, Seoul (KR); Tae-kyun Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 468 days.

(21) Appl. No.: 10/712,356

(22) Filed: Nov. 14, 2003

(65) Prior Publication Data

US 2004/0141031 A1 Jul. 22, 2004

(30) Foreign Application Priority Data

Dec. 30, 2002 (KR) ..... 10-2002-0086846

(51) Int. Cl.
*B41J 2/14* (2006.01)
*B41J 2/16* (2006.01)

(52) U.S. Cl. ..... 347/47

(58) Field of Classification Search ..... 347/20, 347/40, 44, 47, 50, 54, 56, 65; 216/27; 430/320
See application file for complete search history.

(56) References Cited

FOREIGN PATENT DOCUMENTS

EP 1 153 749 A1 * 11/2001

* cited by examiner

*Primary Examiner*—Shih-Wen Hsieh
(74) *Attorney, Agent, or Firm*—Staas & Halsey LLP

(57) ABSTRACT

A monolithic bubble ink jet print head includes an anti-curing-deformation part formed at at least one of an inner surface of a nozzle plate or a chamber/nozzle plate forming ink chambers and an outer surface of the nozzle plate or the chamber/nozzle plate forming a front or outer surface of the printer head to prevent an abnormal deformation from being generated in the nozzle plate or the chamber/nozzle plate during a curing process. A fabrication method of a monolithic bubble-ink jet print head includes forming a sacrificial photo resist mold having a flow channel structure including ink chambers and restrictors on the substrate, forming a chamber/nozzle plate having an anti-curing-deformation part and nozzles on the sacrificial photo resist mold, removing the sacrificial photo resist mold from the substrate over which chamber/nozzle plate is formed, and curing the substrate from which the sacrificial photo resist mold is removed.

16 Claims, 18 Drawing Sheets

FIG. 5A
(PRIOR ART)
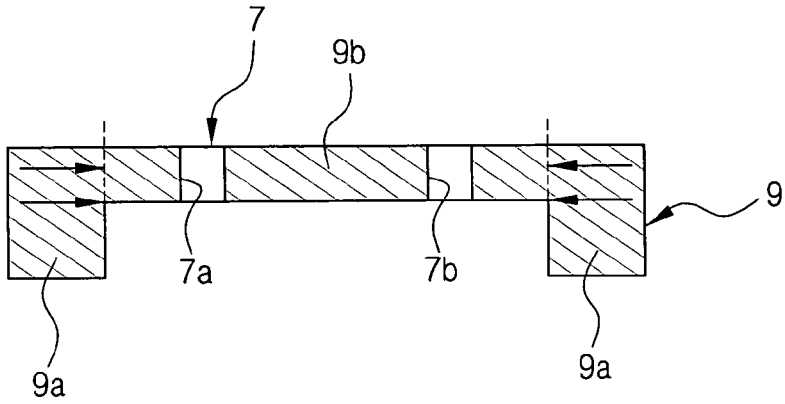
FIG. 5B
(PRIOR ART)
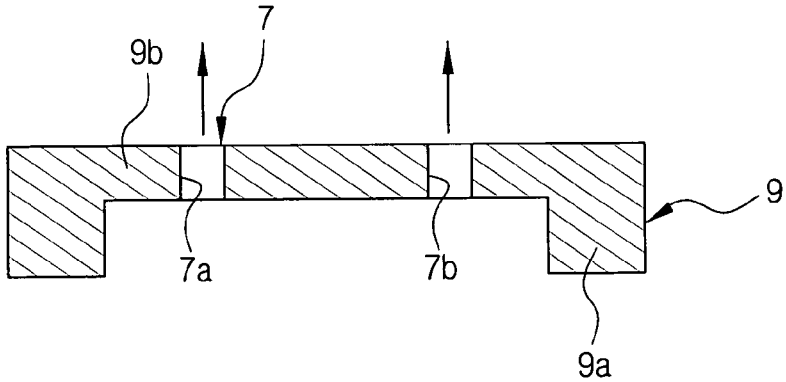
FIG. 5C
(PRIOR ART)

MONOLITHIC BUBBLE-INK JET PRINT HEAD HAVING ANTI-CURING-DEFORMATION PART AND FABRICATION METHOD THEREOF

CROSS-REFERENCE TO RELATED APPLICATIONS

This application claims the benefit of Korean Application No. 2002-86846, filed Dec. 30, 2002, in the Korean Intellectual Property Office, the disclosure of which is incorporated herein by reference.

BACKGROUND OF THE INVENTION

1. Field of the Invention

The present invention relates to a print head of an ink-jet printer and a fabrication method thereof, and more particularly, to a monolithic bubble-ink jet print head and a fabrication method thereof, having an anti-curing-deformation part to prevent a nozzle plate or a chamber/nozzle plate from being abnormally deformed during ultraviolet (UV) curing or thermal hardening.

2. Description of the Related Art

Since an ink-jet printer is excellent in prevention of noise and in obtaining a high resolution, and it is also capable of performing color printing at a low cost, consumer demand for the ink-jet printer has been increased.

Also, with the development of the semiconductor technology, a fabrication technology of a print head, which is a main component of the ink-jet printer, has been actively developed during the past decade. As a result, a print head having about 300 injection nozzles and providing a resolution of 1,200 dpi is being used in a disposable ink cartridge.

FIGS. 1A and 1B schematically show a conventional print head 10 for an ink-jet printer.

Generally, ink is supplied from a back surface of a substrate 1 of the print head 10 to a front surface of the substrate 1 through an ink supply channel 2.

The ink supplied through the first ink supply channel 2 flows along restrictors 3 defined by a chamber wall or plate 9*a* and a nozzle plate 9*b* to reach ink chambers 4. The ink temporarily stagnating in the ink chambers 4 is instantly boiled by a heat generated from heaters 6 disposed under a protective layer 5, wherein the heaters 6 are connected to a contact pad 8 that is contacted to a lead terminal of an outer circuit to receive an electrical signal therefrom.

As a result, the ink generates an explosive bubble and, due to the bubble, some of the ink in the ink chambers 4 is discharged outwardly from the print head 10 through nozzles 7 formed above the ink chambers 4.

In such a print head 10, a chamber/nozzle plate 9 having the chamber plate 9*a* and the nozzle plate 9*b*, which are formed in a body or are formed in two different units, is an important factor that affects an ink flow, an injection pattern of the ink, an injection frequency, and the like. Accordingly, materials, shapes and fabrication methods of the chamber/nozzle plate 9 have been the subject of considerable research.

Current methods of fabricating the print head in relation to the chamber plate and the nozzle plate are an adhering method, i.e., separately fabricating a substrate and a nozzle plate, aligning and then adhering them to each other by utilizing a photosensitive high molecular weight thin layer, and a monolithic method directly forming a substrate and a nozzle plate in a body or in two different units on a substrate.

The adhering method may be classified into two types: a first type of separately fabricating only a nozzle plate, aligning and then adhering it on a substrate having a chamber plate made of polymer by utilizing an adhesive, and a second type of fabricating a nozzle plate and a chamber plate together, aligning and then adhering it on a substrate by utilizing an adhesive.

Generally, the fabrication method of the print head employing the monolithic method has the following advantages as compared with the adhering method.

First, there is no need for an adhesive, that is, a photosensitive high molecular weight thin layer that has to meet a particular condition is not required. Also, it is also not required to precisely align a nozzle plate and a substrate and adhere them to each other by utilizing the photosensitive high molecular thin weight layer, and equipment necessary to perform this work is also not required.

Secondly, a substrate, a chamber plate and a nozzle plate may be aligned more precisely as compared with the adhering method. Therefore, fabrication cost is reduced and productivity is increased by reducing the number of fabrication processes, and an advantage is achieved in that the print head no longer requires a precise alignment and a high resolution.

The following description sets forth a fabrication process of a general print head 10 according to a monolithic method that directly forms a chamber plate and a nozzle plate on a substrate.

First, as shown in FIG. 2A, a heater 6 and a protective layer 5 are formed on a silicone substrate 1.

Next, a preliminary ink supply channel 2' that is used to form an ink supply channel 2 later is formed in a back surface of the substrate 1. At this time, a part of the substrate 1 at which the preliminary ink supply channel 2' is formed is not completely removed and penetrated, but is left at a certain thickness.

After that, a positive photo resist is formed on the protective layer 5 of the substrate 1. The positive photo resist is patterned by a photolithography process that utilizes a photo mask (not shown). As a result, as shown in FIG. 2B, a positive photo resist mold 3' of a sacrificial layer is formed on the protective layer 5. The positive photo resist mold 3' provides a flow channel structure that includes restrictors 3 and ink chambers 4 that are removed through an etching process later. A thickness of the positive photo resist mold 3' has a height substantially the same as the height of the restrictors 3 and the ink chambers 4 to be formed later.

After forming the positive photo resist mold 3' on the protective layer 5, a whole surface of the substrate 1 is coated with a photosensitive epoxy resin as a negative photo resist.

After that, the negative photo resist is exposed to UV by using a photo mask (not shown) in which a shape of the nozzles 7 is patterned, and then a part of the chamber/nozzle plate 9, except for a part hardened by being exposed to the UV, is dissolved and removed by a developing liquid. As a result, as shown in FIG. 2C, a chamber/nozzle plate 9 having the nozzles 7 formed therethrough is obtained.

After the chamber/nozzle plate 9 is formed, as shown in FIG. 2D, the part of the silicon substrate 1, at which the preliminary ink supply channel 2' is formed, is isotropically etched, so that an ink supply channel 2 is formed.

After that, as shown in FIG. 2E, the photo resist mold 3' is dissolved and removed by a solvent. As a result, ink chambers 4 and restrictors 3 are formed in the chamber/nozzle plate 9.

After the formation of the chamber/nozzle plate 9, to enhance mechanical strength and corrosion resistance of the chamber/nozzle plate 9 and to adhere the chamber/nozzle plate 9 to the substrate 1 more closely, as well as to enhance endurance of the flow channel structure, a curing process applies the UV and heat to the chamber/nozzle plate 9 to increase a molecular weight, i.e., a cross linking density of the chamber/nozzle plate 9, with respect to the resultant substrate 1, and the fabrication of the print head 10 is finally completed.

Such a conventional monolithic method of fabricating the print head 10 has an advantage that the nozzle plate and the chamber plate are not separately formed, but are formed in a single body. However, the monolithic method of fabricating the print head 10 presents a problem that the chamber/nozzle plate 9 may be abnormally deformed due to curing conditions during the curing processing.

More specifically, if the curing processing is carried out at a relatively high temperature, the photosensitive epoxy resin of the chamber/nozzle plate 9 may reach the cross linking density in a short time, but the chamber/nozzle plate 9 may be abnormally deformed due to an increase in compressive stress applied thereto.

However, if the curing processing is carried out at a relatively low temperature, a time required for the photosensitive epoxy resin to reach the cross linking density is increased, lengthening the processing consumption time. Also, the compressive stress applied to the chamber/nozzle plate 9 may be decreased, but the chamber/nozzle plate 9 may still have abnormal deformation.

This abnormal deformation of the chamber/nozzle plate 9 generated during the curing process assumes a convex form 11 when the compressive stress is applied to a lower part of the nozzle plate 9*b* that is larger than an upper part thereof, as shown in FIG. 3A, whereas the chamber/nozzle plate 9 assumes a concave form of 11' when the compressive stress is applied to the lower part of the nozzle plate 9*b* that is smaller than the upper part thereof, as shown in FIG. 4A.

Also, the deformation is generally generated at a region of the nozzles 7*a* and 7*b* in odd and even rows positioned at a center part (a center in a longitudinal direction of FIG. 1A) of the chamber/nozzle plate 9 that is larger than regions of the nozzles 7*a* and 7*b* that are located in the odd and even rows positioned at both edge parts of the chamber/nozzle plate 9.

Such an abnormal deformation of the chamber/nozzle plate 9 affects a quality in the image that is to be printed on a sheet of paper.

For example, when a vertical line is printed, the nozzles 7*a* in the odd row and the nozzles 7*b* in the even row jet ink alternately perform the printing operation. At this time, the print head 10 prints one vertical line when an alignment error between the nozzles 7*a* in the odd row and the nozzles 7*b* in the even row is within a tolerance limit.

That is, as is shown in FIG. 5B, when there is no abnormally deformed part in the chamber/nozzle plate 9, or when there is an abnormally deformed part in the chamber/nozzle plate 9, but it is positioned at the edge part of the chamber/nozzle plate 9 adhered to the substrate 1 to allow the alignment error between the nozzles 7*a* and 7*b* to be in the tolerance limit, the nozzles 7*a* and 7*b* print one vertical line, as shown in FIG. 5C.

However, as is shown in FIG. 3B, when the chamber/nozzle plate 9 has a part deformed in the convex form 11, since the nozzles 7*a* in the odd row and the nozzles 7*b* in the even row are misaligned with respect to one another at the deformed part of the chamber/nozzle plate 9, they print one line at an upper part and a lower part of the vertical line, but they print two lines at a center part of the vertical line providing a line that corresponds to the deformed part, as is shown in FIG. 3C.

Also, as is shown in FIG. 4B, when the chamber/nozzle plate 9 has a part deformed in the concave form 11', since the nozzles 7*a* in the odd row and the nozzles 7*b* in the even row are misaligned with respect to one another at the deformed part of the chamber/nozzle plate 9, they print two lines at an upper part and a lower part of the vertical line that corresponds to the deformed part, as shown in FIG. 4C.

FIG. 6 is a schematic representation of a printing result in which vertical and horizontal lines are printed by a print head in which the chamber/nozzle plate 9 has the center part deformed in the convex form 11, as is shown in FIG. 3B. FIG. 6 shows that in the vertical lines, a portion printed by the nozzles 7*a* in the odd row and the nozzles 7*b* in the even row positioned at the edge part of the chamber/nozzle plate 9, results in one line, whereas a portion printed by the nozzles 7*a* in the odd row and the nozzles 7*b* in the even row positioned at the center part of the chamber/nozzle plate 9, results in two lines. To the contrary, it shows that in the horizontal lines, the portions printed by the nozzles 7*a* in the odd row and the nozzles 7*b* in the even row positioned at the edge part and the center part of the chamber/nozzle plate 9 result in one line.

SUMMARY OF THE INVENTION

The present invention has been developed to solve the above and/or other problems in the related art. Accordingly, an aspect of the present invention is to provide a monolithic bubble-ink jet print head and a fabrication method thereof, wherein the print head has an anti-curing-deformation part which prevents an abnormal curing deformation from being generated in a nozzle plate or a chamber/nozzle plate during UV curing or thermal hardening, thus preventing deterioration of a quality in an image.

Another aspect of the present invention is to provide a monolithic bubble-ink jet print head and a fabrication method thereof, wherein the print head has an anti-curing-deformation part which prevents an abnormal curing deformation from being generated in a nozzle plate or a chamber/nozzle plate during UV curing or thermal hardening regardless of a curing condition, a size of the head, an arrangement of nozzles, a material of the nozzle plate or the chamber/nozzle plate and the like, by properly combining or changing a shape, an arrangement, and a distribution of the anti-curing-deformation part.

Still another aspect of the present invention is to provide a monolithic bubble-ink jet print head and a fabrication method thereof, wherein the print head has an anti-curing-deformation part to prevent an abnormal curing deformation from being generated in a nozzle plate or a chamber/nozzle plate during UV curing or thermal hardening, thus forming the nozzle plate or the chamber/nozzle plate without using a low temperature curing method that requires excessive expense and time.

A further aspect of the present invention is to provide a monolithic bubble-ink jet print head and a fabrication method thereof, wherein the print head has an anti-curing-deformation part to prevent an abnormal curing deformation from being generated in a nozzle plate or a chamber/nozzle plate during UV curing or thermal hardening, so that a discharging channel may be used to remove ink spouted on an outer surface of the nozzle plate or the chamber/nozzle plate during printing when the discharging channel is formed on the outer surface of the nozzle plate or the chamber/nozzle plate.

According to an embodiment of the present invention to achieve the above aspects and other features, a monolithic bubble-ink jet print head comprises a substrate having a plurality of resistance heat emitting bodies to heat ink and an ink supply opening to supply ink from an ink cartridge, a chamber plate formed on the substrate to form a flow channel structure, including a plurality of restrictors connected with the ink supply opening and a plurality of ink chambers connected with the restrictors, and a nozzle plate formed on the chamber plate with a plurality of nozzles formed therethrough, wherein the nozzle plate has an anti-curing-deformation part formed at at least one of an inner surface thereof to form the ink chambers at an outer surface thereof to form a front or outer surface of the printer head to prevent an abnormal deformation from being generated therein during a curing process.

In an embodiment, the nozzle plate is formed of a negative photo resist. The negative photo resist may be made of a photosensitive polymer selected from a group including a resin of an epoxy group, a resin of a polyimid group, and a resin of a polyacrylate group.

Alternatively, the nozzle plate may be formed using a thermosetting polymer. Generally, the thermosetting polymer may comprise, for example, one of a polymer of an epoxy group, a polymer of a polyimid group, and a polymer of a polyacrylate group.

In an embodiment, the chamber plate and the nozzle plate may be formed in a body using a same material.

Also, the anti-curing-deformation part may comprise at least one groove, disposed in a longitudinal direction between rows of the nozzles of the nozzle plate.

The groove may comprise one groove formed of one of a shape that has a wide width at a center part in the longitudinal direction of the nozzle plate and a narrow width at both edge parts in the longitudinal direction of the nozzle plate, and a shape that has a same width at the center part and at the both edge parts, or may comprise a plurality of grooves formed of one of a shape in which at least two grooves having a wide width at the center part and a narrow width at both edge parts are arranged in a row, a shape in which at least two grooves having a same width at the center part and at both edge parts are arranged in a row, a shape in which at least two grooves having a wide width at the center part and a narrow width at both edge parts are arranged parallel with each other in at least two rows, a shape in which at least two grooves having the same width at the center part and at both edge parts are arranged parallel with each other in at least two rows, a shape in which at least two grooves having a wide width at the center part and a narrow width at both edge parts are arranged to alternate with each other in at least two rows, and a shape in which at least two grooves having the same width at the center part and at both edge parts are arranged to alternate with each other in at least two rows.

The groove may also be formed by additionally coating a negative photo resist on the nozzle plate, and then performing a light exposure and a developing with respect to the negative photo resist by using a photo mask having a pattern of the desired groove and the nozzles. For example, the negative photo resist may comprise one of a liquid photosensitive-negative photo resist selected from a group including a resin of an epoxy group, a resin of a polyimid group, and a resin of a polyacrylate group; and a solid photosensitive-negative photo resist, such as a dry film resist.

Also, the monolithic bubble-ink jet print head of an embodiment of the present invention may further include a contact pad to apply an electrical signal to the resistance heat emitting bodies from an outer circuit; and/or a logic circuit having switching elements to increase driving efficiency of the resistance heat emitting bodies.

According to another embodiment of the present invention, a fabrication method of a monolithic bubble-ink jet print head comprises: providing a substrate having resistance heat emitting bodies and a protective layer formed on one surface thereof, forming a sacrificial photo resist mold having a flow channel structure including ink chambers and restrictors on the protective layer, forming a chamber/nozzle plate having nozzles on the sacrificial photo resist mold, the chamber/nozzle plate including an anti-curing-deformation part formed on an outer surface thereof, removing the sacrificial photo resist mold from the substrate over which the chamber/nozzle plate is formed, and curing the substrate from which the sacrificial photo resist mold is removed.

In an embodiment, the forming the sacrificial photo resist mold may comprise forming a positive photo resist on the protective layer, and performing a light exposure and a developing with respect to the positive photo resist by using a photo mask having a pattern of the flow channel structure. For example, the positive photo resist may be formed of a photosensitive polymer comprising a resin of a novolac group. The positive photo resist may be formed with a thickness ranging from 5 μm to 50 μm. Also, the process of performing the light exposure and the developing with respect to the positive photo resist is generally carried out by using an exposure of UV ranging from 2 mJ/cm$^2$ to 4,000 mJ/cm$^2$.

The forming the chamber/nozzle plate may comprise coating a first negative photo resist on the substrate over which the sacrificial photo resist mold is formed, exposing the first negative photo resist to light by using a photo mask having a pattern of the nozzles, coating a second negative photo resist on the exposed first negative photo resist, exposing the second negative photo resist to light by using a photo mask having a pattern of the nozzles and the anti-curing-deformation part, and developing the exposed second negative resist and the exposed first negative photo resist in turn.

The process of coating the first negative photo resist may be carried out by using a photosensitive polymer selected from a group that includes a resin of an epoxy group, a resin of a polyimid group, and a resin of a polyacrylate group, and the process of exposing the first negative photo resist to light may be carried out by using an exposure of UV ranging from 2 mJ/cm$^2$ to 2,000 mJ/cm$^2$.

The process of coating the second negative photo resist may be carried out by using one of a liquid photosensitive-negative photo resist selected from a group that includes a resin of an epoxy group, a resin of a polyimid group, and a resin of a polyacrylate group; and a solid photosensitive-negative photo resist, such as a dry film resist, wherein the process of exposing the second negative photo resist to light may be carried out by using an exposure of UV ranging from 2 mJ/cm$^2$ to 2,000 mJ/cm$^2$.

At this point, the first and the second negative photo resists may be formed by materials different from each other, but generally are formed by the same material, since more precise anti-curing-deformation part and nozzles may be obtained when solubility to a developing liquid during developing is the same.

Also, the anti-curing-deformation part may comprise at least one groove disposed in a longitudinal direction between rows of the nozzles of the chamber/nozzle plate at the outer surface of the chamber/nozzle plate to form an outer or front surface of the print head.

The removing the sacrificial photo resist mold may include dissolving the sacrificial photo resist mold by using a solvent having etch selectivity with respect to a positive photo resist.

The curing the substrate may comprise flood-exposing the substrate to light; and hard-baking the substrate. The process of flood-exposing the substrate may be carried out by using an exposure of UV ranging from 100 mJ/cm$^2$ to 5000 mJ/cm$^2$, and the process of hard-baking the substrate may be carried out for 5 minutes to 2880 minutes at a temperature ranging from 30° C. to 350° C.

In an embodiment, to form an ink supply opening, the method of the present invention may further include the forming a preliminary ink supply opening in the other surface of the substrate after the step of providing the substrate, the preliminary ink supply opening being formed not to completely penetrate the substrate, forming an ink supply opening by etching the preliminary ink supply opening to completely penetrate the substrate after the forming of the chamber/nozzle plate, and cleaning an organic matter flowing into the surfaces of the substrate during the etching. The process of forming the preliminary ink supply opening may be carried out by etching the substrate to a thickness of about 20 μm by an anisotropic dry etching process.

According to still another embodiment of the present invention, a fabrication method of a monolithic bubble-ink jet print head comprises providing a substrate having resistance heat emitting bodies and a protective layer formed on one surface thereof, forming a sacrificial photo resist mold having a flow channel structure including ink chambers and restrictors on the protective layer, forming a chamber/nozzle plate having nozzles on the sacrificial photo resist mold, the chamber/nozzle plate including an anti-curing-deformation part formed on an inner surface thereof, removing the sacrificial photo resist mold from the substrate over which the chamber/nozzle plate is formed, and curing the substrate from which the sacrificial photo resist mold is removed.

In an embodiment, the forming of the sacrificial photo resist mold may comprise forming a positive photo resist on the protective layer, and performing a light exposure and a developing with respect to the positive photo resist by using a photo mask having a pattern of the flow channel structure. Then, the positive photo resist may be formed of a photosensitive polymer comprising a resin of novolac group. The positive photo resist may be formed with a thickness ranging from approximately 5 μm to 50 μm. Also, the process of performing the light exposure and the developing with respect to the positive photo resist may be carried out by using an exposure of UV ranging from 2 mJ/cm$^2$ to 4,000 mJ/cm$^2$.

The forming the chamber/nozzle plate may comprise forming a sacrificial anti-curing-deformation part pattern on the sacrificial photo resist mold by performing a light exposure and a developing with respect to the sacrificial photo resist mold by using a photo mask having a pattern of the anti-curing deformation part, coating a negative photo resist on the sacrificial anti-curing deformation part pattern and the sacrificial photo resist mold, exposing the negative photo resist to light by using a photo mask having a pattern of the nozzles, and developing the exposed negative photo resist.

When forming the sacrificial anti-curing deformation part pattern, the light exposure may be carried out by using an exposure of UV ranging from 2 mJ/cm$^2$ to 2,000 mJ/cm$^2$.

The process of coating the negative photo resist may be carried out by using a photosensitive polymer selected from a group including a resin of an epoxy group, a resin of a polyimid group, and a resin of a polyacrylate group, and the process of exposing the negative photo resist to light may be carried out by using an exposure of UV ranging from 2 mJ/cm$^2$ to 4,000 mJ/cm$^2$.

The anti-curing-deformation part may comprise at least one groove disposed in a longitudinal direction between rows of the nozzles of the chamber/nozzle plate at the inner surface of the chamber/nozzle plate, forming the ink chambers.

The removing the sacrificial photo resist mold may comprise dissolving the sacrificial photo resist mold and the sacrificial anti-curing-deformation part pattern by using a solvent having an etch selectivity with respect to a positive photo resist.

The curing the substrate may comprise flood-exposing the substrate to light, and hard-baking the substrate. The process of flood-exposing the substrate may be carried out by using an exposure of UV ranging from 100 mJ/cm$^2$ to 5000 mJ/cm$^2$, and the process of hard-baking the substrate may be carried out for from 5 minutes to 2880 minutes at a temperature ranging from 30° C. to 350° C.

In an embodiment, to form an ink supply opening, the method of the present invention may further include forming a preliminary ink supply opening in the other surface of the substrate after providing the substrate, the preliminary ink supply opening being formed not to completely penetrate the substrate, forming an ink supply opening by etching the preliminary ink supply opening to completely penetrate the substrate after forming the chamber/nozzle plate, and cleaning an organic matter flowing into the surfaces of the substrate during the etching. The process of forming the preliminary ink supply opening may be carried out to etch the substrate to about 20 μm in thickness using an anisotropic dry etching process.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 3A to 3C, FIGS. 4A to 4C, and FIGS. 5A and 5C are views showing examples wherein a chamber/nozzle plate is abnormally deformed during a curing process, and illustrate results printed by the deformed chamber/nozzle plate;

DETAILED DESCRIPTION OF THE PREFERRED EMBODIMENTS

Figure 1A:
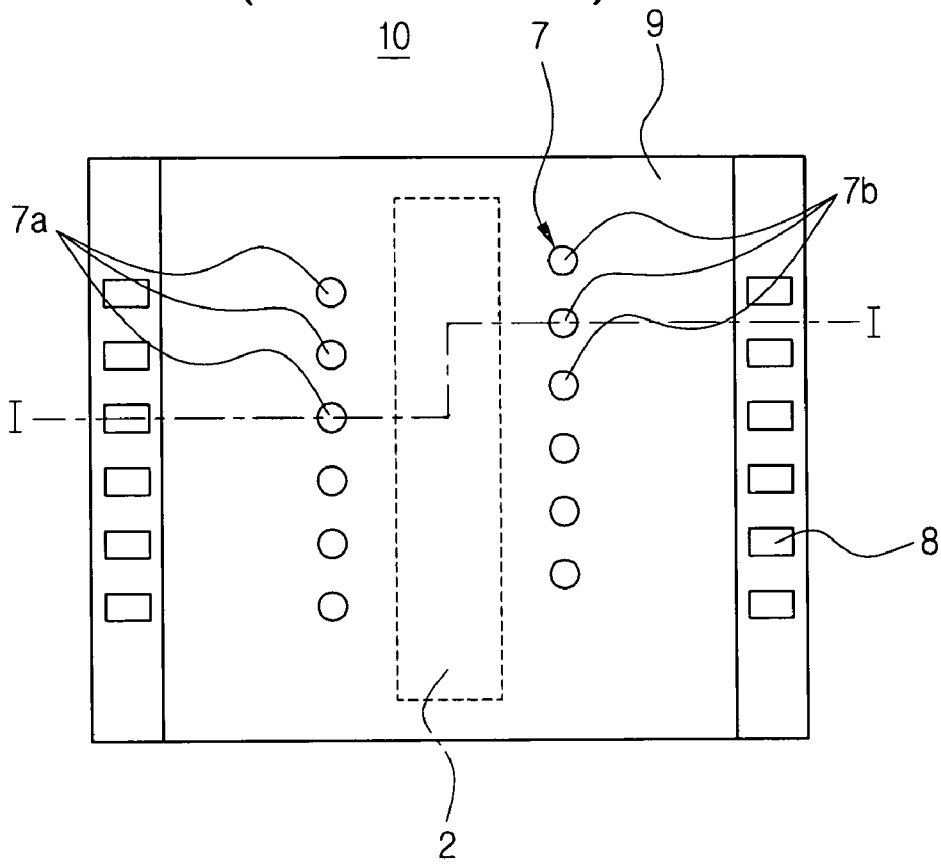
FIG. 1A (PRIOR ART)
FIGS. 1A and 1B are a top plan view and a cross sectional view showing a general print head.
Figure 1B:
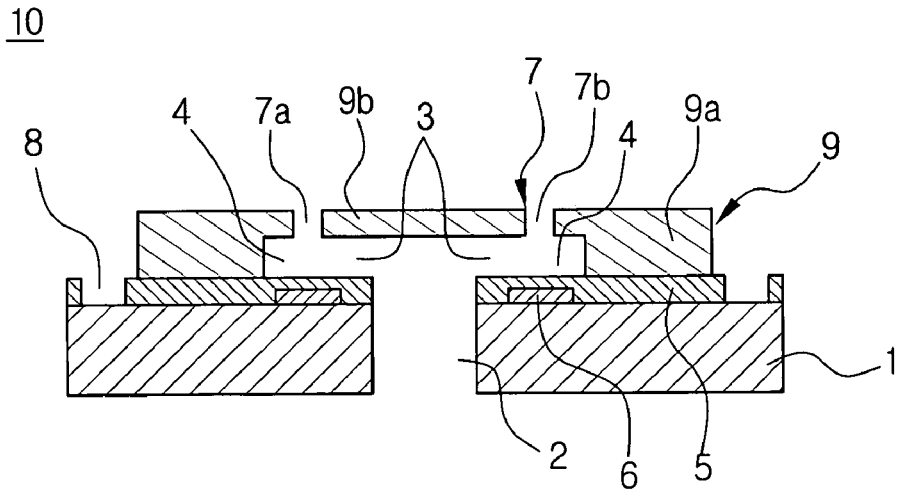
FIG. 1B (PRIOR ART)
Figure 2A:
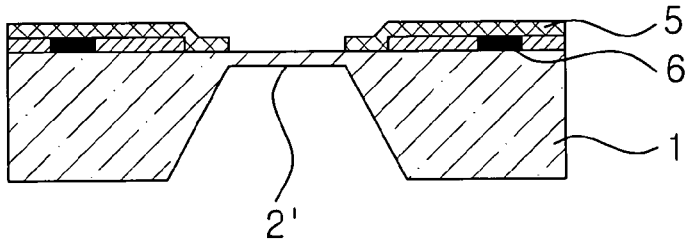
FIG. 2A (PRIOR ART)
FIGS. 2A to 2E are views showing a process of fabricating a bubble ink jet print head according to a conventional monolithic method.
Figure 2B:
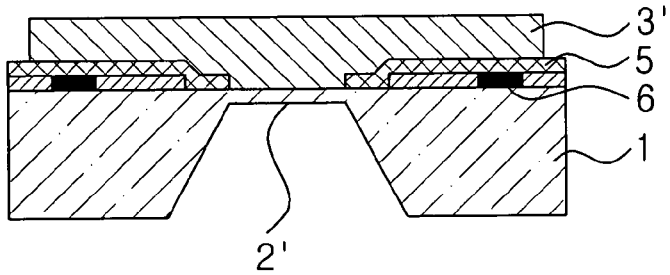
FIG. 2B (PRIOR ART)
Figure 2C:
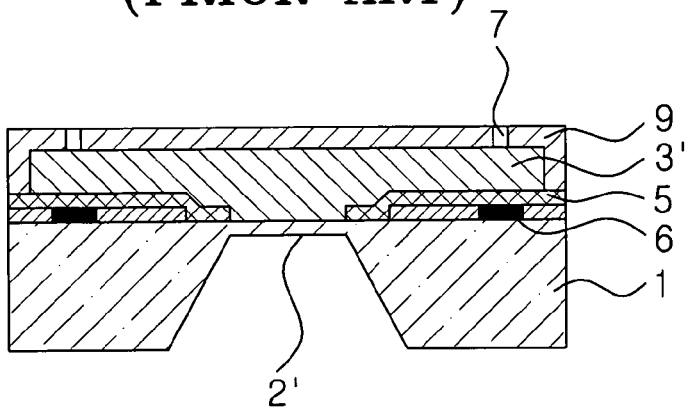
FIG. 2C (PRIOR ART)
Figure 2D:
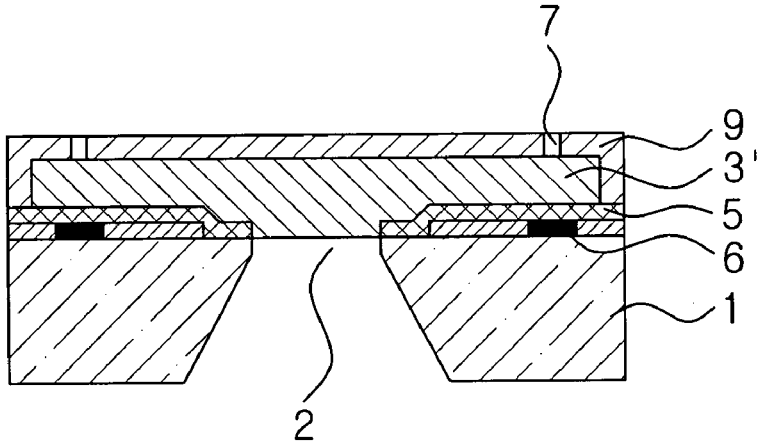
FIG. 2D (PRIOR ART)
Figure 2E:
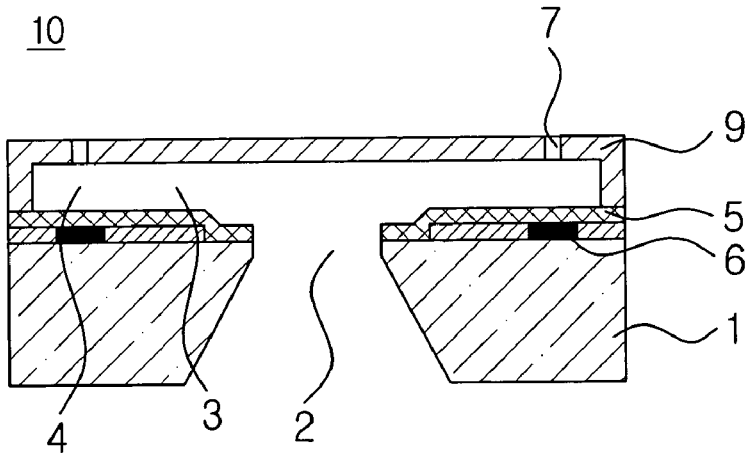
FIG. 2E (PRIOR ART)
Figure 3A:
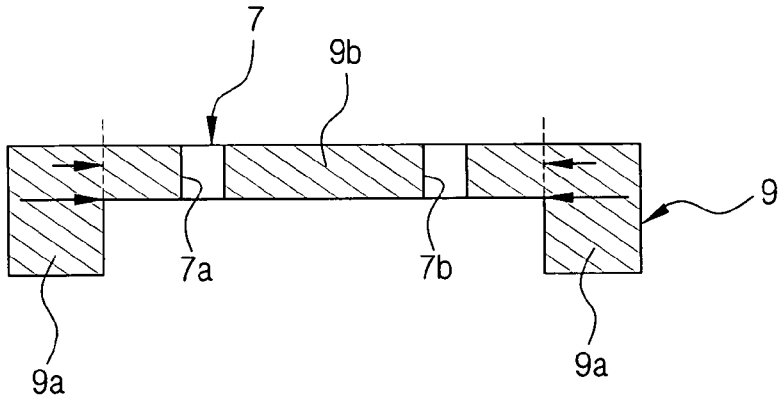
FIG. 3A (PRIOR ART)
Figure 3B:
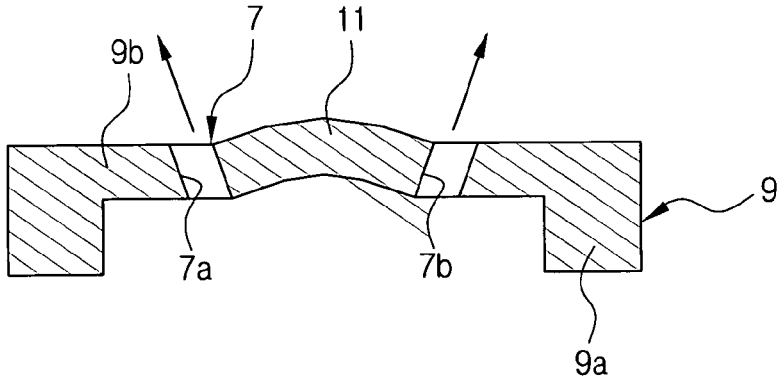
FIG. 3B (PRIOR ART)
Figure 3C:
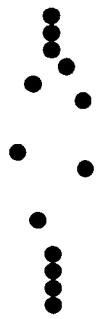
FIG. 3C (PRIOR ART)
Figure 4A:
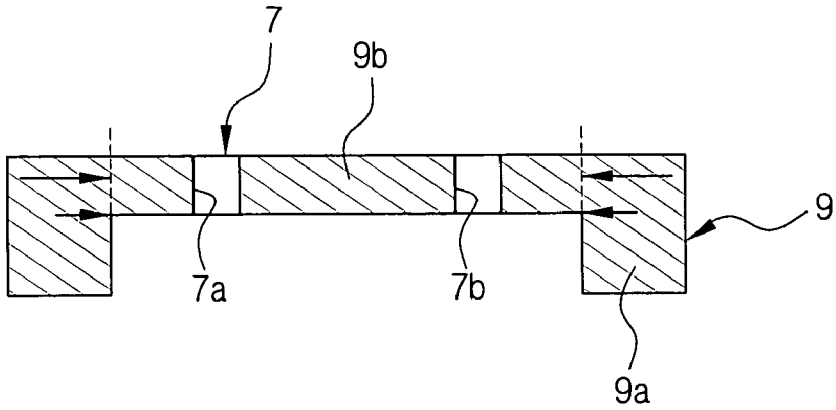
FIG. 4A (PRIOR ART)
Figure 4B:
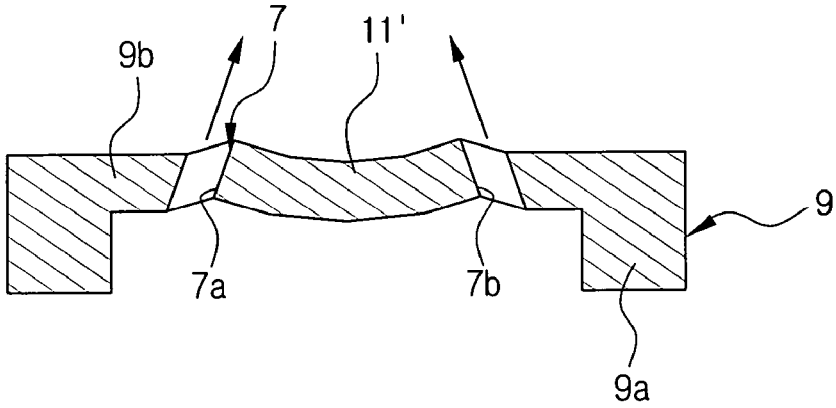
FIG. 4B (PRIOR ART)
Figure 4C:
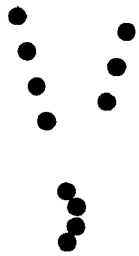
FIG. 4C (PRIOR ART)
Figure 6:
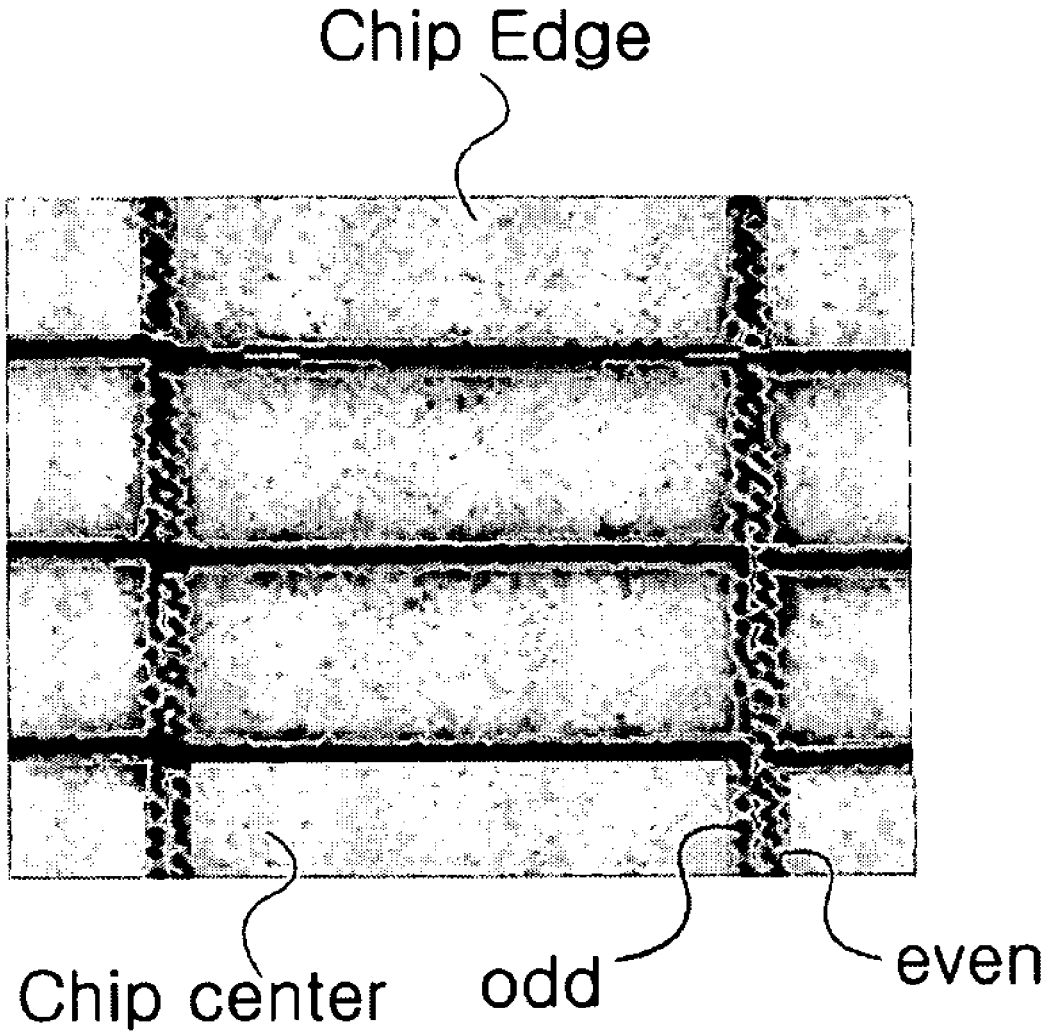
FIG. 6 (PRIOR ART)
FIG. 6 is a schematic representation showing a result printed by using a print head having a deformed nozzle/chamber plate.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a monolithic bubble-ink jet printer and a fabrication method thereof will be described in greater detail with reference to the accompanying drawings.

First Embodiment

Figure 7A:
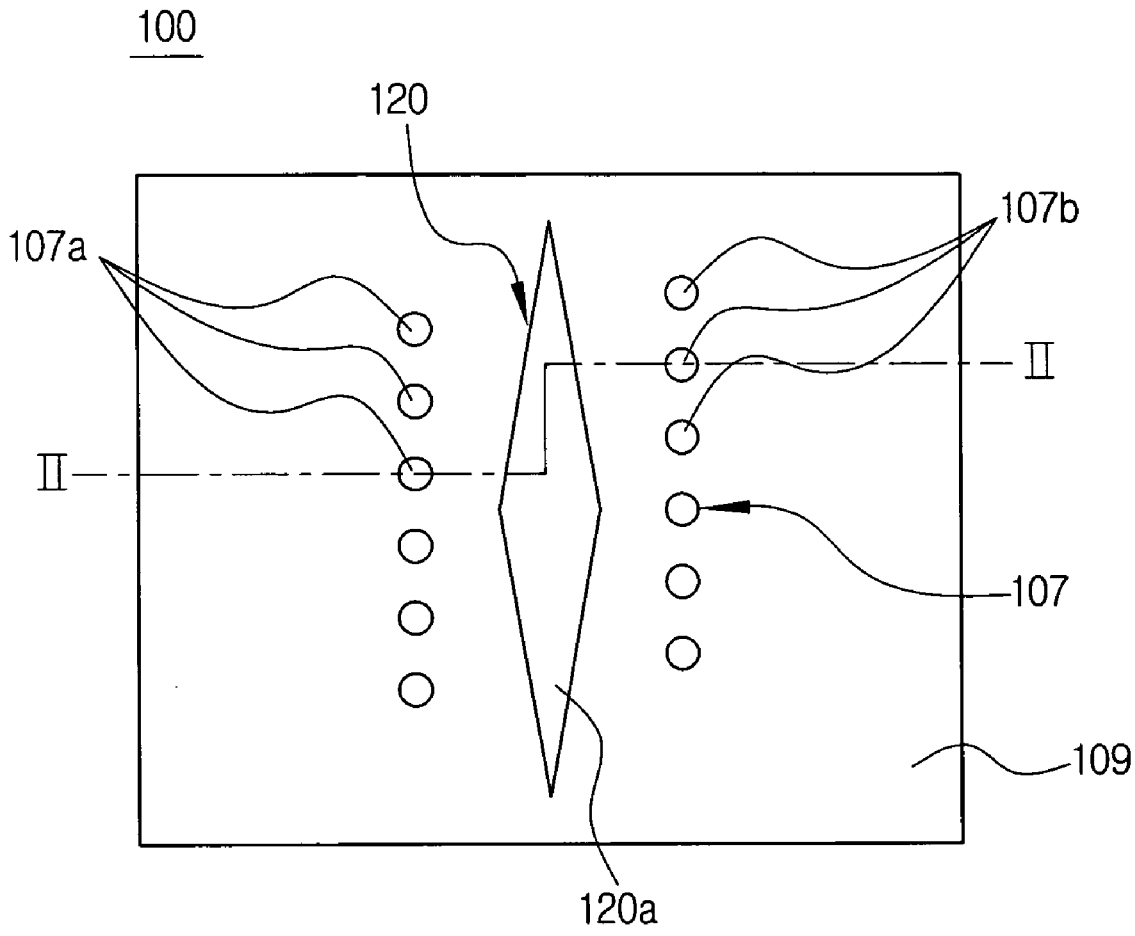
FIGS. 7A to 7C are a top plan view and cross sectional views showing a monolithic bubble-ink jet print head having an anti-curing-deformation part according to an embodiment of the present invention.
Figure 7B:
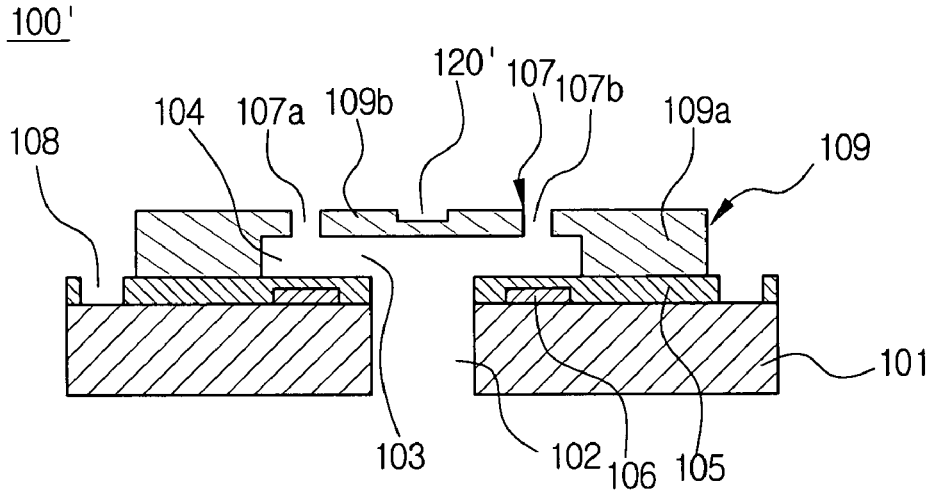
Figure 7C:
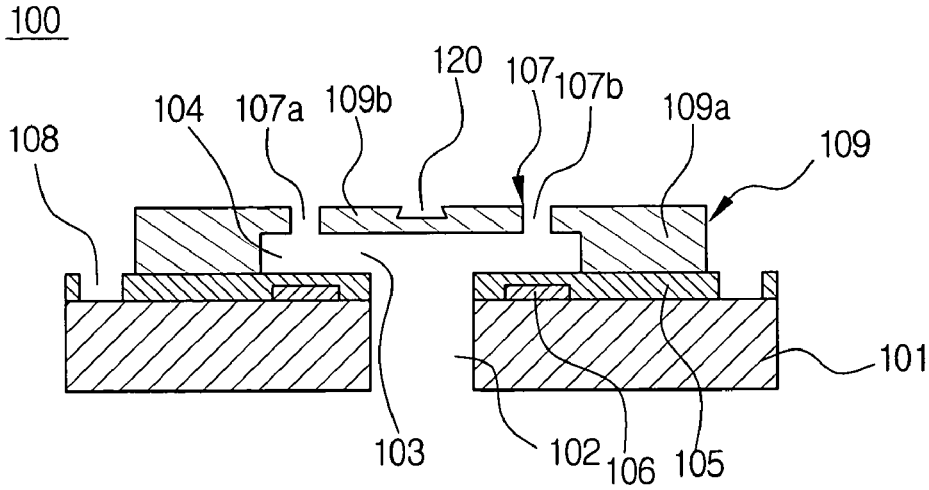

FIGS. 7A to 7C show a monolithic bubble-ink jet print head 100 having an anti-curing-deformation part according to a first preferred embodiment of the present invention.

The print head 100 of the embodiment shown in FIGS. 7A–7C includes a silicon substrate 101 having a plurality of heaters 106 formed thereon to heat ink, and a first ink supply channel 102 constituting an ink supply opening formed therethrough to supply ink from an ink cartridge (not shown), a chamber/nozzle plate 109 having a chamber wall or plate 109*a* formed on the substrate 101 to form a flow channel structure including a plurality of restrictors 103 connected to the ink supply channel 102, a plurality of ink chambers 104 connected to the restrictors 103, a nozzle plate 109*b* formed on the chamber plate 109*a* to form a plurality of nozzles 107, and an anti-curing-deformation part 120 formed on an outer or upper surface of the chamber/nozzle plate 109 to prevent the chamber/nozzle plate 109 from being abnormally deformed during UV curing or thermal hardening.

Each of the heaters 106 may comprise a resistance heat emitting body shaped in a circle or rectangle.

A protective layer 105 is formed on the heaters 106. The protective layer 105 generally comprises a passivation layer (not shown) that includes silicon nitride, silicon carbide and the like, and an anti-cavitation layer made of a metallic layer of Ta, TaN, TiN and the like, vapor-deposited on the passivation layer to isolate the ink.

The ink supply channel 102 may comprise an elongated and rectangle-shaped hole formed to penetrate the substrate 101 to connect with the ink cartridge, wherein the ink supply channel 102 is disposed between nozzles 107*a* in an odd row and nozzles 107*b* in an even row. The rectangle-shaped hole may be formed to have a width ranging from approximately 150 μm to 200 μm by etching a back surface of the substrate 101 through an anisotropic dry etching method. So, a sidewall of the rectangle-shaped hole may be formed in a shape of a right angle.

The chamber plate 109*a* and the nozzle plate 109*b* of the chamber nozzle plate 109 may be formed in a body of one layer made of a negative photo resist, for example, a photosensitive polymer such as a resin of an epoxy group, a resin of a polyimid group, and a resin of a polyarcylate group.

Here, it is noted that in the embodiment, the chamber plate 109*a* and the nozzle plate 109*b* are illustrated and explained as formed in a body of one layer, but the present invention is not limited to this embodiment, and the chamber plate 109*a* and the nozzle plate 109*b* may be separately formed of two different layers.

Also, the chamber plate 109*a* and the nozzle plate 109*b* may be formed of a thermosetting polymer, for example, one of a polymer of an epoxy group, a polymer of a polyimid group, and a polymer of a polyarcylate group.

The anti-curing-deformation part 120 may be composed of at least one groove disposed in a longitudinal direction between the nozzles 107*a* in the odd row and the nozzles 107*b* in the even row at the upper surface of the chamber/nozzle plate 109, forming a front surface of the print head 100.

The groove prevents the chamber/nozzle plate 109 from being abnormally deformed to change an ink jetting direction of the nozzles 107, and thus decreasomg the printing quality when it is affected by compressive stress during the curing process that is carried out under a high temperature and heat. For example, a groove 120' (FIG. 7B) before the curing process is deformed into a groove 120 shown in FIG. 7C after performing the curing process, and thus the nozzles 107 of the chamber/nozzle plate 109 do not change the ink jetting direction, but jet ink normally.

Also, the groove 120 may be used as a discharging channel to remove ink spouted on the upper surface of the chamber/nozzle plate 109 during printing.

The groove 120 may be formed by additionally coating a negative photo resist on the nozzle plate 109*b*, and then performing a light exposure and a developing with respect to the negative photo resist by using a photo mask having a pattern of the groove 120 and the nozzles 107.

At this point, as the negative photo resist, a liquid photosensitive-negative photo resist composed of a resin of an epoxy group, a resin of a polyimid group, or a resin of a polyacrylate group; or a solid photosensitive-negative photo resist, such as a dry film resist may be used.

Figure 8A:
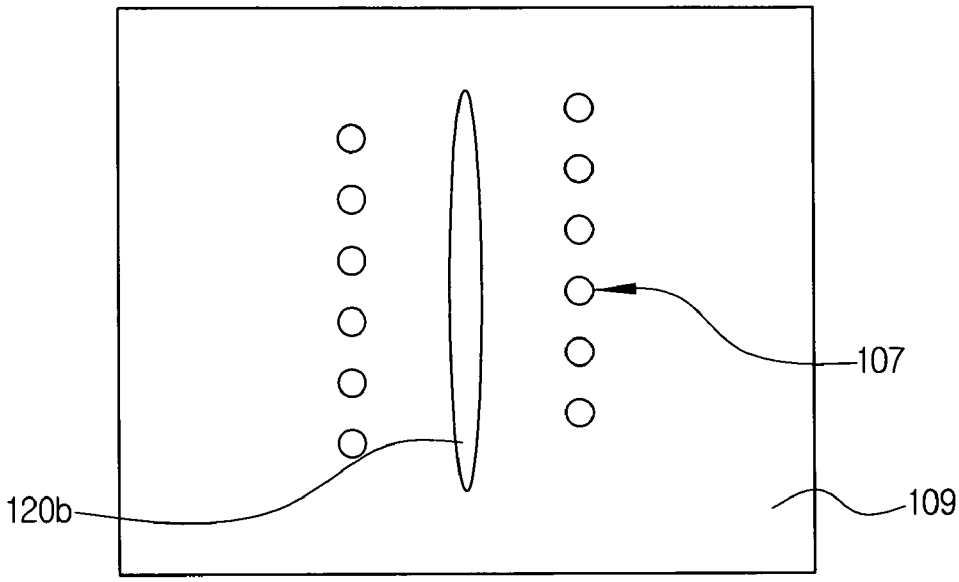
FIGS. 8A to 8F are top plan views showing examples of the anti-curing-deformation part of the print head shown in FIG. 7C.
Figure 8B:
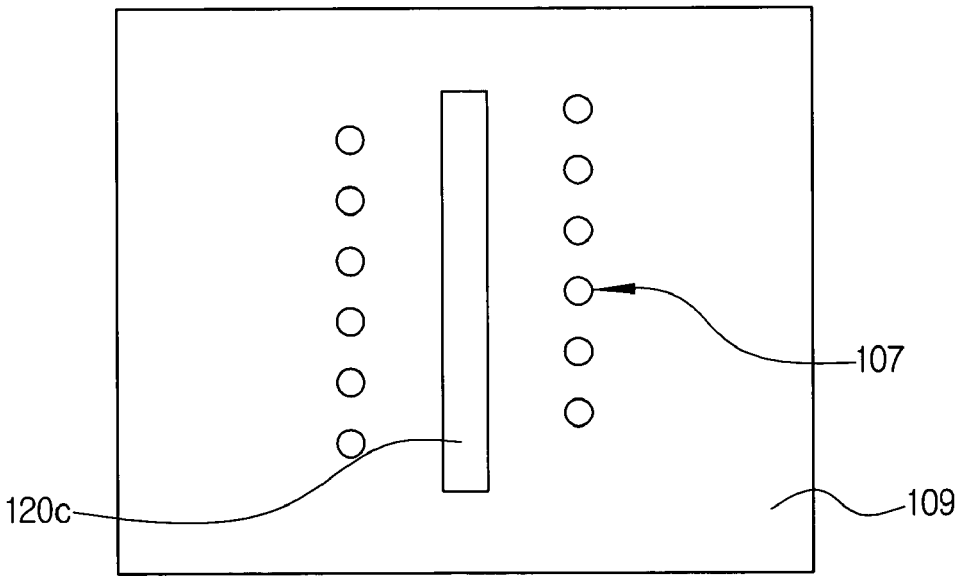
Figure 8C:
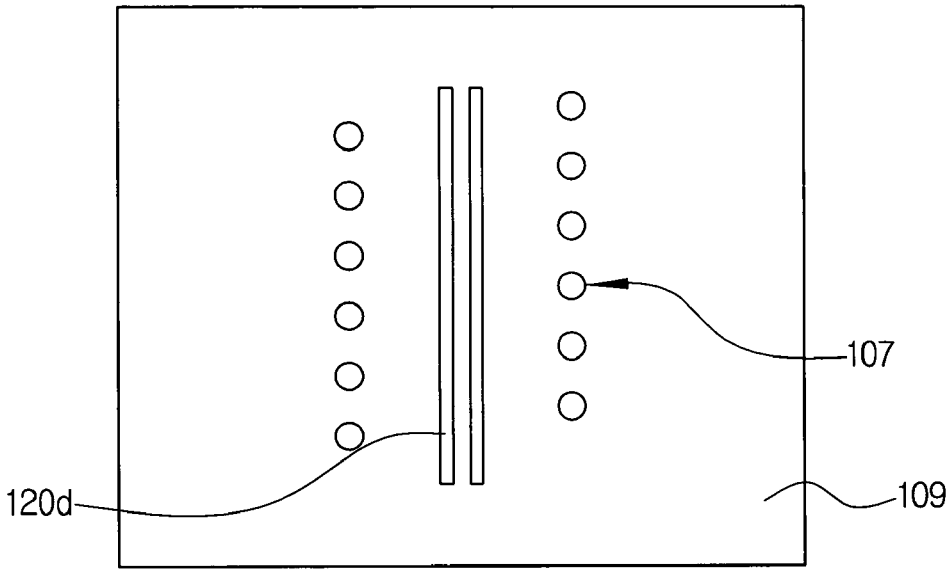
Figure 8D:
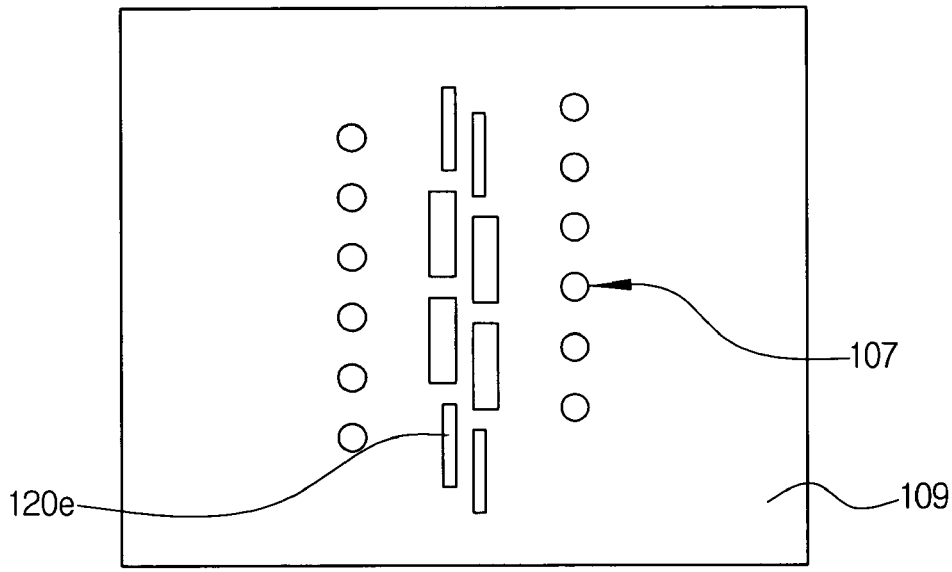
Figure 8E:
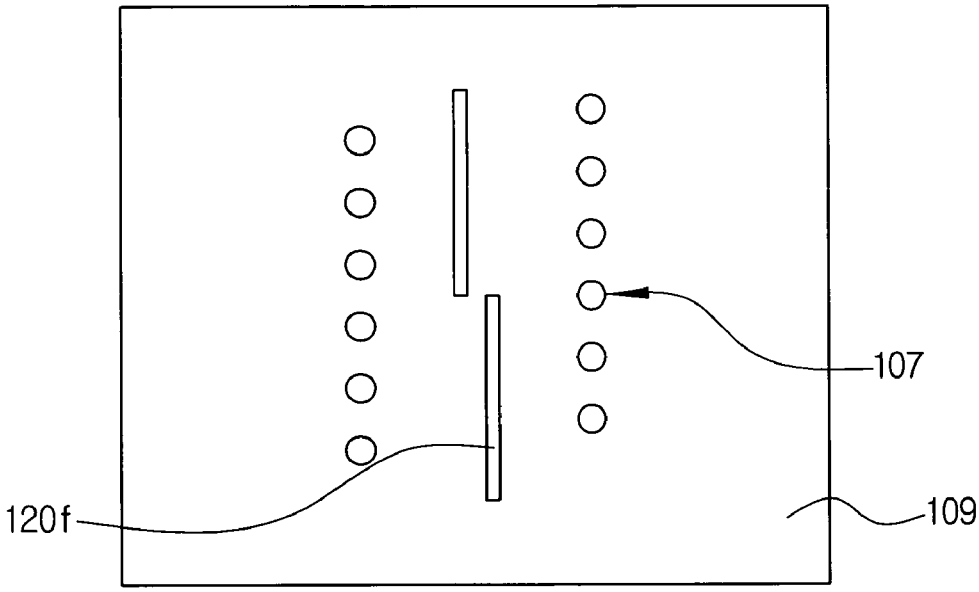
Figure 8F:
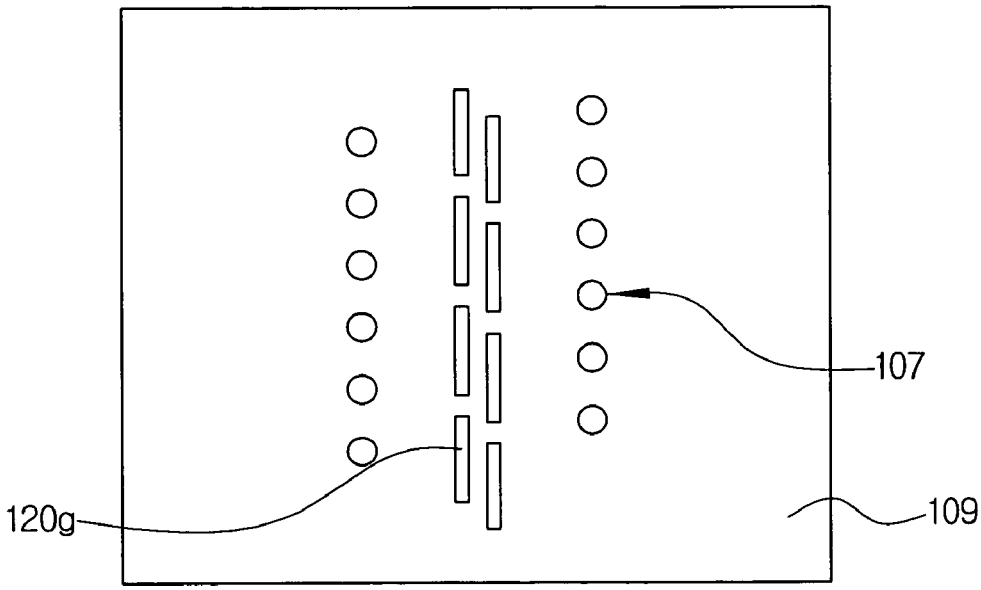

The groove 120 may be one groove formed of one of a shape 120*a* or 120*b* that has a wide width at a center part in the longitudinal direction of the chamber/nozzle plate 109 and a narrow width at both edge parts in the longitudinal direction of the chamber/nozzle plate 109, and a shape 120*c* that has the same width at the center part and at both edge parts, as shown in FIGS. 7A, 8A and 8B; or a plurality of grooves formed of one of a shape 120*d* of which at least two grooves having the same width at the center part and at both edge parts are arranged parallel with each other in at least two rows, a shape 120*e* of which at least two grooves having a wide width at the center part and a narrow width at both edge parts are arranged to alternate with each other in at least two rows, and a shape 120*f* or 120*g* of which at least two grooves having the same width at the center part and at both edge parts are arranged to alternate with each other in at least two rows, as shown in FIGS. 8C through 8G.

In addition, the groove 120 may comprise a shape of which at least two grooves having the same width at the center part and at the both edge parts are arranged in a row, a shape of which at least two grooves having a wide width at the center part and a narrow width at the both edge parts are arranged in a row, a shape of which at least two grooves having a wide width at the center part and a narrow width at the both edge parts are arranged parallel with each other in at least two rows, and the like.

Also, as shown in FIG. 7C, the print head 100 of the present invention may further include a contact pad 108 positioned around the chamber/nozzle plate 109 to apply an electrical signal to the heaters 106 from an outer circuit (not shown), and a logic circuit (not shown) having switching elements (not shown) such as a gate, a source and a drain of a transistor to increase a driving efficiency of the heaters 106.

A fabrication method of the monolithic bubble ink jet print head 100, as constructed according to an embodiment of the present invention will be described in great detail with reference to FIGS. 9A through 9G.

First, a silicon substrate 101 has an isolation layer (not shown), an interlayer insulating layer (not shown), heaters 106 and a protective layer 105 formed in turn thereon.

The, the heaters 106 are formed by selectively etching a relatively lower resistance metallic layer among the metallic thin layers having high and low specific resistances, or by vapor-depositing ploy silicon, in which impurities are doped on a front surface of the silicon substrate 101, and then patterning.

Also, before forming the heaters 106, switching elements forming the logic circuit such as a transistor, a wire connecting the switching elements, a contact pad 108 connecting the wire to a lead terminal of the outer circuit and the like are formed over the substrate 101.

The protective layer 105 formed on the heater 106 comprises a passivation layer (not shown) made of silicon nitride, silicon carbide and the like, and an anti-cavitation layer made of a metallic layer of Ta, TaN, TiN and the like vapor-deposited on the passivation layer.

Figure 9A:
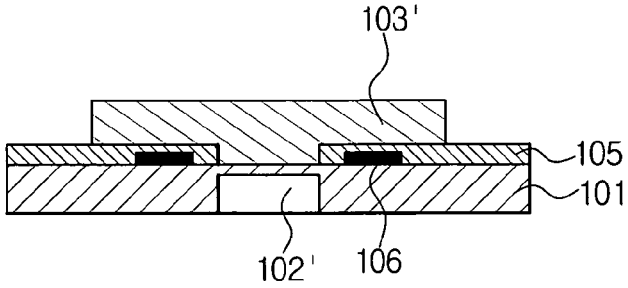
FIGS. 9A to 9G are views showing a process of fabricating the print head shown in FIG. 7C.

Next, as shown in FIG. 9A, in a back surface of the silicon substrate 101 is formed a preliminary ink supply channel 102' to form the ink supply channel 102 constituting an ink supply opening later. At this time, a part of the substrate 101 at which the preliminary ink supply channel 102' is formed is not completely removed and penetrated, but left about 20 μm in thickness.

After that, on the protective layer 105 of the substrate 101 a positive photo resist is formed, and the positive photo resist is exposed to UV and developed by a photolithography process of using a photo mask (not shown) having a pattern of flow channel structure including restrictors 103 and ink chambers 104. As a result, on the protective layer 105 is formed a sacrificial photo resist mold 103' as a sacrificial layer.

At this time, the positive photo resist may be formed of a photosensitive polymer made of a resin of a novolac group, and the UV exposure at the photolithography process is carried out by using an exposure of UV ranging from 2 $mJ/cm^2$ to 4,000 $mJ/cm^2$.

The sacrificial photo resist mold 103' is removed later to provide the flow channel structure of the restrictors 103 and the ink chamber 102. Also, since a thickness of the sacrificial photo resist mold 103' comes to a height of the restrictors 103 and the ink chamber 102, it is determined according to an amount of a droplet of ink discharged from the nozzles 107 one time, which affects a resolution. The droplet amount depends on various flow channel structures, such as a height of the ink chambers 104, a size of the restrictors 103, a diameter of the nozzles 107, and a size of the heaters 106, which are classified by products. Accordingly, to satisfy the various flow channel structures, the positive photo resistor mold 103' is generally formed ranging from approximately 5 μm to 50 μm in thickness.

Figure 9B:
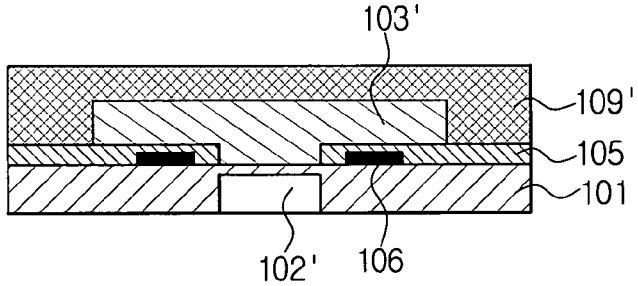

After forming the positive photo resistor mold 103' on the protective layer 105, as shown in FIG. 9B, a first negative photo resist 109' is formed on a whole surface of the substrate 101. The first negative photo resist 109' is formed by coating a photosensitive polymer comprising one of a resin of a epoxy group, a resin of a polyimid group, or a resin of a polyacrylate group.

Figure 9C:
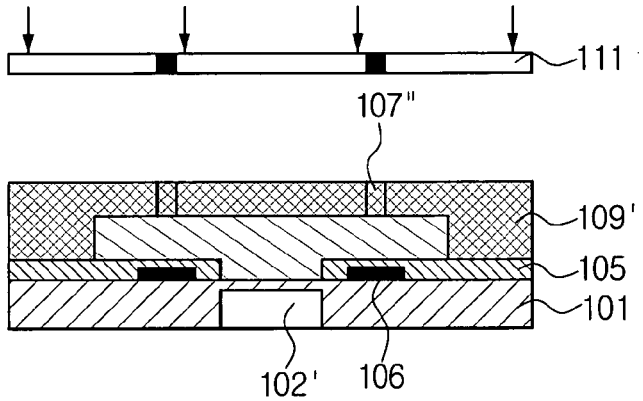

Subsequently, as shown in FIG. 9C, the first negative photo resist 109' is exposed to the UV by using a photo mask 111 in which a shape of the nozzles 107 is patterned. As a result, a part, except for a part 107" from which the nozzles 107 will be formed, is hardened. At this point, the UV exposure is carried out by using an exposure of UV ranging from 2 $mJ/cm^2$ to 2,000 $mJ/cm^2$.

Figure 9D:
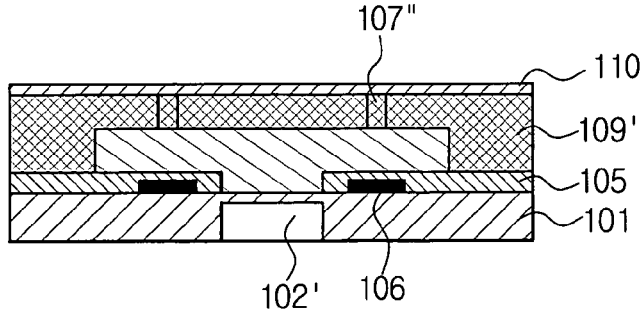

After that, as shown in FIG. 9D, a second negative photo resist 110 is formed on the exposed first negative photo resist 109'. The second negative photo resist 110 may be formed by coating a liquid photosensitive polymer comprising a resin of an epoxy group, a resin of a polyimid group, or a resin of a polyacrylate group, e as in the case of the first negative photo resist 109', or by laminating a solid photosensitive-negative photo resist, such as a dry film resist, at a high heat and pressure.

Then, the second negative photo resist 110 may be formed of a material that is different from that of the first negative photo resist 109', but generally is the same material as that of the first negative photo resist 109', since a more precise anti-curing-deformation part 120 and nozzles 107 may be obtained when solubility in a developing liquid during developing is the same.

Figure 9E:
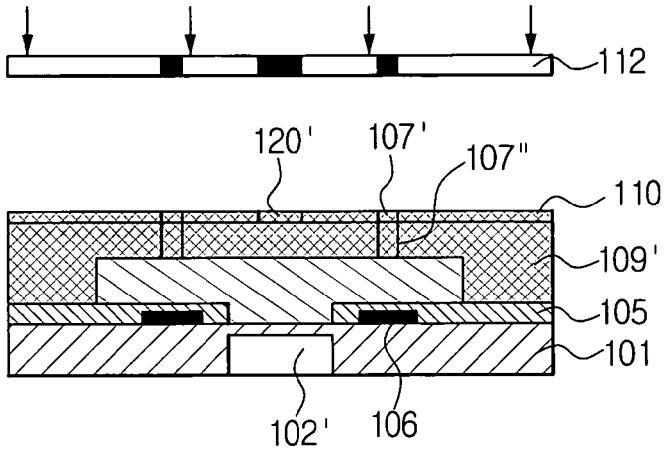

After forming the second negative photo resist 110 on the first negative photo resist 109', as shown in FIG. 9E, the second negative photo resist 110 is exposed to the UV by using a photo mask 112 having a pattern of the anti-curing-deformation part 120 and the nozzles 107. As a result, a part, except for parts 120' and 107' located in the anti-curing-deformation part 120 and the nozzles 107, will be formed, respectively, is hardened. Then, the UV exposure of the second negative photo resist 110 may be carried out by using an exposure of UV ranging from approximately 2 $mJ/cm^2$ to 2,000 $mJ/cm^2$.

Figure 9F:
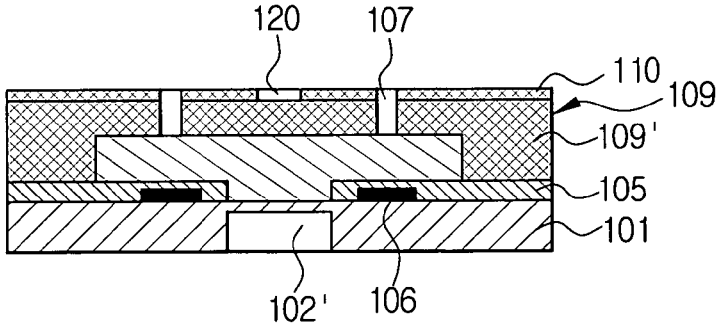
Figure 9G:
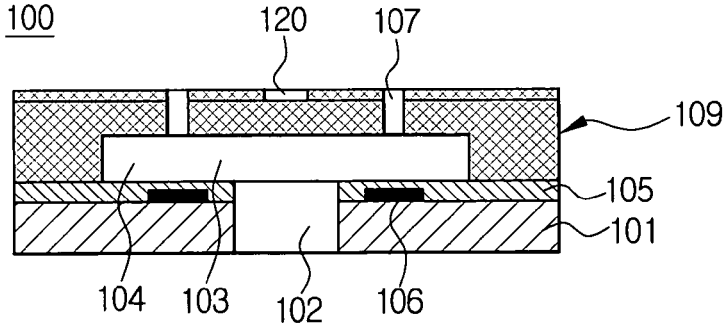

After that, the exposed second negative photo resist 110 and the exposed first negative photo resist 109' are developed in turn by a developing liquid having an etch selectivity with respect to the first and second negative photo resist 109' and 110. As a result, as shown in FIG. 9F, the parts 120', 107' and 107" not exposed to the UV are dissolved and removed from the first and second negative photo resist 109' and 110, forming the nozzle plate 109*b* of the chamber/nozzle plate 109 by the developing liquid, so that the anti-curing-deformation part 120 and the nozzles 107 are formed.

As shown in FIG. 7A and FIGS. 8A through 8F, the anti-curing-deformation part 120 comprises at least one groove disposed in the longitudinal direction between nozzles 107*a* in the odd row and nozzles 107*b* in the even row at the upper surface of the chamber/nozzle plate 109 forming the front surface of the print head 100.

After that, a part of the silicon substrate 101 at which the preliminary ink supply channel 102' is formed is anisotropically etched by a dry etch method, so that an ink supply channel 102 is formed.

After cleaning an organic matter flowing into the surfaces of the substrate 101 during the etching, the sacrificial photo resist mold 103' is dissolved and removed by a solvent having an etch selectivity with respect to the positive photo resist, forming the sacrificial photo resist mold 103'. Thus, the chamber/nozzle plate 109 in which the ink chambers 104 and the restrictors 103 are formed is obtained.

After the formation of the chamber/nozzle plate 109, to enhance mechanical strength and corrosion resistance of the chamber/nozzle plate 109 and to adhere the chamber/nozzle plate 109 to the substrate 101 more closely, and thus enhance the endurance of the flow channel structure, a curing process applies the UV and heat to the substrate 101, to increase] thus increasing a molecular weight, i.e., a cross linking density of the chamber/nozzle plate 109 is performed with respect to the resultant substrate 101, and the fabrication of the print head 100 is finally completed.

Then, the curing process is carried out by flood-exposing the resultant substrate 101 by using an exposure of UV ranging from 100 mJ/cm$^2$ to 5000 mJ/cm$^2$, and then hard-baking the resultant substrate 101 for 5 minutes to 2880 minutes, for example, 30 minutes at a temperature ranging from 30° C. to 350° C., for example 130–150° C.

Second Embodiment

Figure 10A:
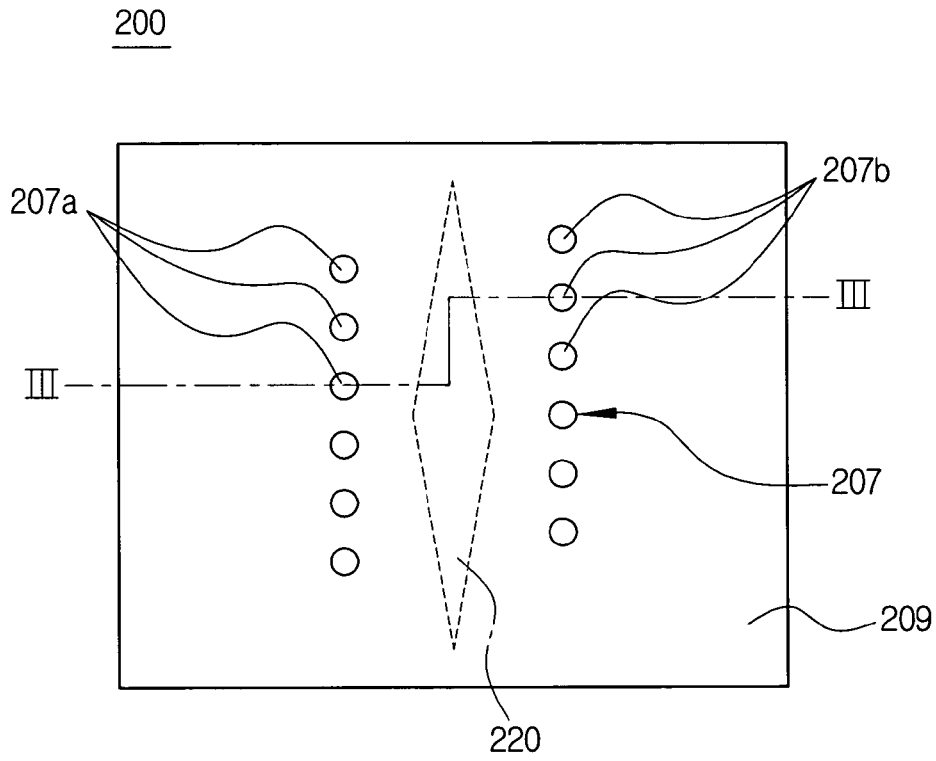
FIGS. 10A to 10C are a top plan view and cross sectional views showing a monolithic bubble-ink jet print head having an anti-curing-deformation part according to another embodiment of the present invention.
Figure 10B:
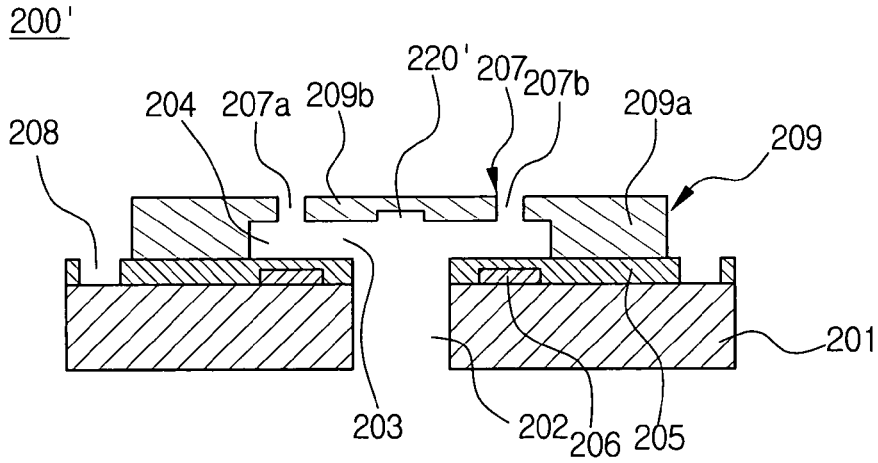
Figure 10C:
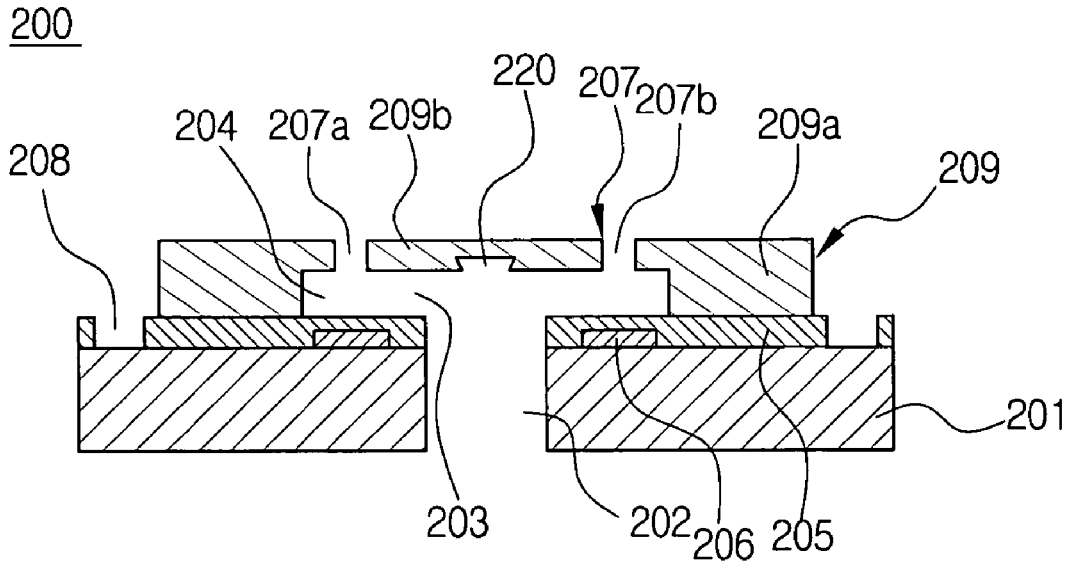

FIGS. 10A to 10C show a monolithic bubble-ink jet print head 200 having an anti-curing-deformation part according to an embodiment of the present invention.

The print head 200 of this embodiment is identical to that of the first preferred embodiment, except that an anti-curing-deformation part 220 is disposed at an inner surface of a chamber/nozzle plate 209, forming ink chambers 204. Accordingly, the description about the construction of the print head 200 will be omitted here.

A fabrication method of the monolithic bubble-ink jet print head 100 as constructed according to the first embodiment of the present invention will be described in great detain with reference to FIGS. 11A through 11G.

Figure 11A:
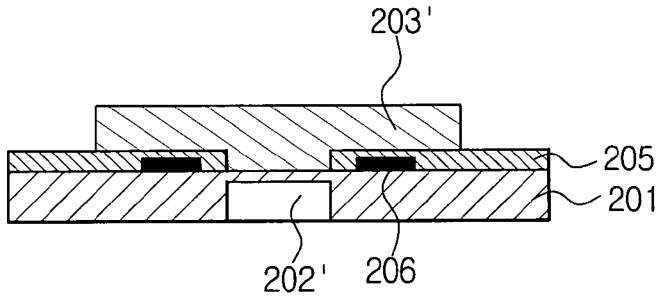
FIGS. 11A to 11G are views showing a process of fabricating the print head shown in FIG. 10C.

First, in a silicon substrate 201 having heaters 206, a protective layer 205 formed in turn thereon, as shown in FIG. 11A, a preliminary ink supply channel 202' and a sacrificial photo resist mold 203' are formed in the same manner as that of the first embodiment.

Figure 11B:
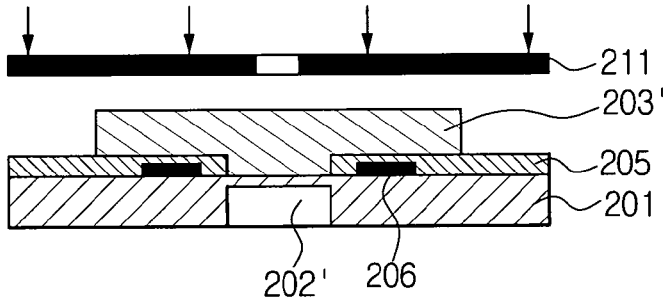

After the sacrificial photo resist mold 203' is formed, as shown in FIG. 11B, the sacrificial photo resist mold 203' is exposed to UV by using a photo mask 211 having a pattern of an anti-curing-deformation part 220. At this point; the UV exposure is carried out by using an exposure of UV ranging from approximately 2 mJ/cm$^2$ to 2,000 mJ/cm$^2$.

Figure 11C:
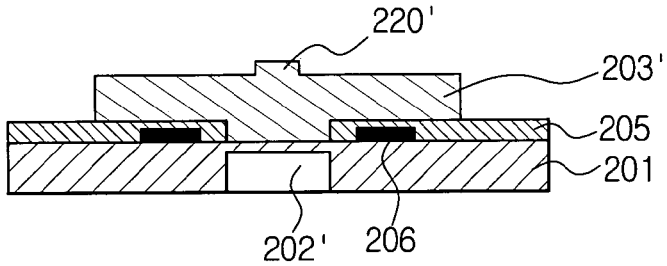

After the UV exposure, the sacrificial photo resist mold 203' is developed. As shown in FIG. 11C, a part not exposed to the UV is dissolved and removed from the sacrificial photo resist mold 203', so that a sacrificial anti-curing-deformation part pattern 220' is formed at an upper part of the sacrificial photo resist mold 203'.

Figure 11D:
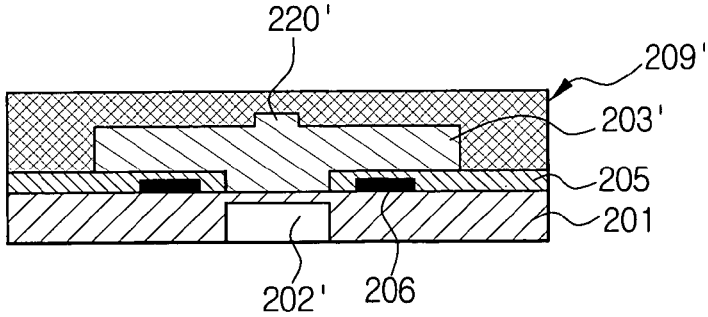

After that, as shown in FIG. 11D, a negative photo resist 209' is formed on a whole surface of the substrate 201 over which the sacrificial photo resist mold 203' and the sacrificial anti-curing-deformation part pattern 220' are formed. At this point, the negative photo resist 209' is formed by coating a photosensitive polymer composed of one of a resin of a epoxy group, a resin of a polyimid group, and a resin of a polyacrylate group.

Figure 11E:
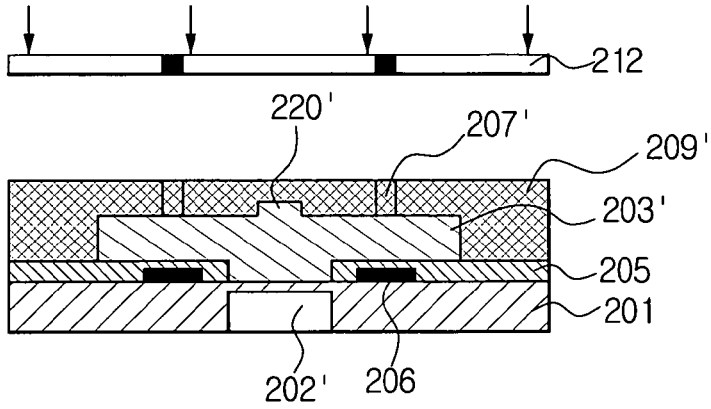

Subsequently, as shown in FIG. 11E, the negative photo resist 209' is exposed to the UV by using a photo mask 212 in which a shape of the nozzles 207 is patterned. As a result, a part, except for a part 207' in which the nozzles 207 will be formed is hardened. At this point, the UV exposure is carried out by using an exposure of UV ranging from approximately 2 mJ/cm$^2$ to 2,000 mJ/cm$^2$.

Figure 11F:
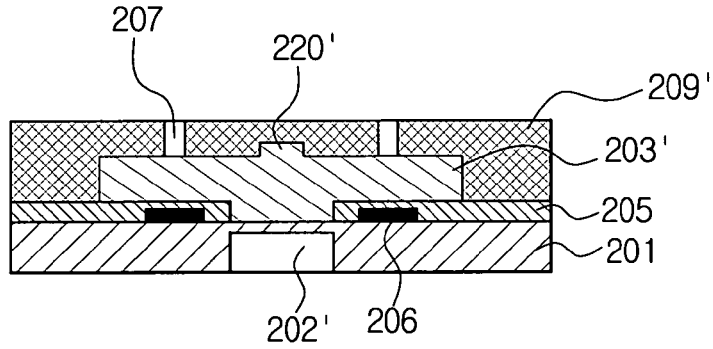
Figure 11G:
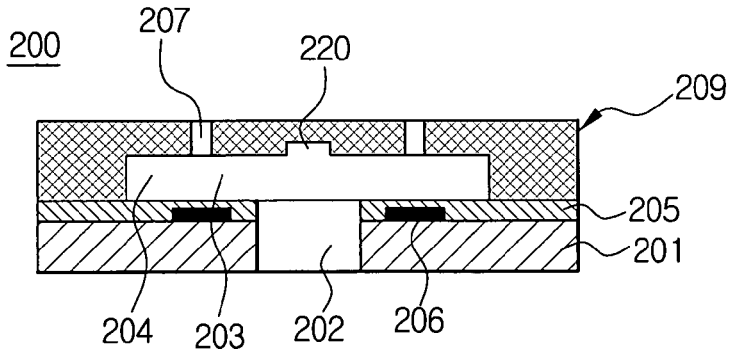

After that, the exposed negative photo resist 209' is developed by a developing liquid having an etch selectivity with respect to the photosensitive polymer forming the exposed negative photo resist 209'. As a result, as shown in FIG. 11F, the part 207' not exposed to the UV is dissolved and removed from the negative photo resist 209' by the developing liquid, so that the nozzles 207 are formed through the negative photo resist 209'.

Thereafter, a part of the silicon substrate 201 at which the preliminary ink supply channel 202' is formed is anisotropically etched by a dry etch method, so that the ink supply channel 202 is formed.

After cleaning an organic matter flowing into the surfaces of the substrate 201 during the etching, the sacrificial photo resist mold 203' and the sacrificial anti-curing-deformation part pattern 220' are dissolved and removed by a solvent having an etch selectivity with respect to the positive photo resist forming the sacrificial photo resist mold 203'. Thus, the chamber/nozzle plate 209 in which the anti-curing-deformation part 220, the ink chambers 204 and the restrictors 203 are formed, is obtained.

At this point, as shown in FIG. 10A and FIGS. 8A through 8F, the anti-curing-deformation part 220 comprises at least one groove disposed in the longitudinal direction between nozzles 207*a* in the odd row and nozzles 207*b* in the even row at the inner surface of the chamber/nozzle plate 209, forming the ink chambers 204.

After the formation of the chamber/nozzle plate 209, to enhance mechanical strength and corrosion resistance of the chamber/nozzle plate 209 and to adhere the chamber/nozzle plate 209 to the substrate 201 more closely, thus to enhance the endurance of the flow channel structure, a curing process applies the UV and heat to the substrate 201 to increase a molecular weight, i.e., a cross linking density of the chamber/nozzle plate 209 is performed with respect to the resultant substrate 201, and the fabrication of the print head 200 of the second embodiment is completed.

As is apparent from the foregoing description, it can be appreciated that the monolithic bubble-ink jet print head and the fabrication method thereof according to an embodiment of the present invention may prevent the nozzle plate or the chamber/nozzle plate from being abnormally deformed during the UV curing or thermal hardening by providing the anti-curing-deformation part formed through a simple additional photolithography process.

Further, the monolithic bubble-ink jet print head and the fabrication method thereof according to an embodiment of the present invention provide an effect that prevents the nozzle plate or the chamber/nozzle plate from being abnormally deformed, regardless of the curing condition, the size of the head, the arrangement of the nozzles, the material of the chamber/nozzle plate and the like, by properly combining or changing the shape, the arrangement, and the distribution of the anti-curing-deformation part.

Still further, the monolithic bubble-ink jet print head and the fabrication method thereof according to an embodiment of the present invention may form the nozzle plate or the chamber/nozzle plate without using a low temperature curing method that requires substantial expense and time, and thus may reduce fabrication cost.

Also, the monolithic bubble-ink jet print head and the fabrication method thereof according to an embodiment of the present invention provides the anti-curing-deformation part that may be used as a discharging channel to remove ink spouted on the outer surface of the nozzle plate or the chamber/nozzle plate during printing, when the anti-curing deformation part is formed on the outer surface of the nozzle plate or the chamber/nozzle plate.

Although a few embodiments of the present invention have been shown and described, it would be appreciated by those skilled in the art that changes may be made in this embodiment without departing from the principles and spirit of the invention, the scope of which is defined in the claims and their equivalents. For example, in the described embodiments, the anti-curing-deformation part is illustrated and explained as being disposed at one of the outer and inner surfaces of the chamber/nozzle plate, but it may be formed in a customary shape and arrangement at both the outer and inner surfaces of the chamber/nozzle plate. Accordingly, the scope of the present invention is not limited within the described range but is defined by the following claims.

What is claimed is:

1. A monolithic bubble-ink jet print head comprising:

a substrate having a plurality of resistance heat emitting bodies to heat ink and an ink supply opening to supply the ink from an ink cartridge;

a chamber plate formed on the substrate to form a flow channel structure including a plurality of restrictors connected with the ink supply opening and a plurality of ink chambers connected with the restrictors; and a nozzle plate formed on the chamber plate to have a plurality of nozzles formed therethrough, wherein the nozzle plate has an anti-curing-deformation part formed at at least one of an inner surface thereof forming the ink chambers and an outer surface thereof forming a front or outer surface of the printer head to prevent an abnormal deformation from being generated therein during a curing process, wherein the anti-curing-deformation part comprises at least one groove disposed in a longitudinal direction between rows of the nozzles of the nozzle plate.

2. The monolithic bubble-ink jet print head of claim 1, wherein the nozzle plate is formed of a negative photo resist.

3. The monolithic bubble-ink jet print head of claim 2, wherein the negative photo resist comprises a photosensitive polymer selected from a group including a resin of an epoxy group, a resin of a polyimid group, and a resin of a polyacrylate group.

4. The monolithic bubble-ink jet print head of claim 1, wherein the nozzle plate is formed of a thermosetting polymer.

5. The monolithic bubble-ink jet print head of claim 4, wherein the thermosetting polymer comprises one of a polymer of an epoxy group, a polymer of a polyimid group, and a polymer of a polyacrylate group.

6. The monolithic bubble-ink jet print head of claim 1, wherein the chamber plate and the nozzle plate are formed in a body using a same material.

7. The monolithic bubble-ink jet print head of claim 1 wherein the at least one groove comprises a groove formed of one of:

a shape that has a wide width at a center part in the longitudinal direction of the nozzle plate and a narrow width at both edge parts in the longitudinal direction of the nozzle plate, and a shape that has a same width at the center part and at the both edge parts.

8. The monolithic bubble-ink jet print head of claim 1 wherein the at least one groove comprises a plurality of grooves formed of one of:

a shape of which at least two grooves having a wide width at a center part in the longitudinal direction of the nozzle plate and a narrow width at both edge parts in the longitudinal direction of the nozzle plate are arranged in a row;

a shape of which at least two grooves having a same width at the center part and at both edge parts are arranged in a row;

a shape of which at least two grooves having a wide width at the center part and a narrow width at both edge parts are arranged parallel with each other in at least two rows;

a shape of which at least two grooves having a same width at the center part and at both edge parts are arranged parallel with each other in at least two rows;

a shape of which at least two grooves having a wide width at the center part and a narrow width at both edge parts are arranged to alternate with each other in at least two rows; and a shape of which at least two grooves having a same width at the center part and at both edge parts plate are arranged to alternate with each other in at least two rows.

9. The monolithic bubble-ink jet print head of claim 1, wherein the at least one groove is formed by additionally coating a negative photo resist on the nozzle plate and then performing a light exposure and a developing with respect to the negative photo resist by using a photo mask having a pattern of the groove and the nozzles.

10. The monolithic bubble-ink jet print head of claim 9, wherein the negative photo resist comprises one of:

a liquid photosensitive-negative photo resist selected from a group including a resin of an epoxy group, a resin of a polyimid group, and a resin of a polyacrylate group; and a solid photosensitive-negative photo resist.

11. The monolithic bubble-ink jet print head of claim 10, wherein the solid photosensitive-negative photo resist is a dry film resist.

12. The method of claim 11, wherein the dry film resist is a derivative of acrylate compound.

13. The method of claim 11, wherein the dry film resist is a derivative of epoxy compound.

14. The monolithic bubble-ink jet print head of claim 1, further comprising a contact pad to apply an electrical signal to the resistance heat emitting bodies from an outer circuit.

15. The monolithic bubble-ink jet print head of claim 14, further comprising a logic circuit having switching elements to increase a driving efficiency of the resistance heat emitting bodies.

16. A monolithic bubble-ink jet print head having a nozzle plate with a plurality of nozzles formed therethrough, wherein the nozzle plate has an anti-curing-deformation part, the anti-curing-deformation part comprising:

a portion formed at at least one of an inner surface forming the ink chambers and an outer surface thereof forming a front or outer surface of the printer head to prevent an abnormal deformation from being generated therein during a curing process, wherein the anti-curing-deformation part comprises at least one groove disposed in a longitudinal direction between rows of the nozzles of the nozzle plate.

* * * * *

UNITED STATES PATENT AND TRADEMARK OFFICE

CERTIFICATE OF CORRECTION

PATENT NO. : 7,168,787 B2
APPLICATION NO. : 10/712356
DATED : January 30, 2007
INVENTOR(S) : Myung-Song Jung et al.

It is certified that error appears in the above-identified patent and that said Letters Patent is hereby corrected as shown below:

Column 15, Line 53, after "claim 1" insert --,--.

Column 15, Line 62, after "claim 1" insert --,--.

Signed and Sealed this

First Day of May, 2007

JON W. DUDAS
*Director of the United States Patent and Trademark Office*